US009073364B2

(12) United States Patent
Sanada

(10) Patent No.: US 9,073,364 B2
(45) Date of Patent: Jul. 7, 2015

(54) PRINTING APPARATUS

(71) Applicant: TOSHIBA TEC KABUSHIKI KAISHA, Shinagawa-ku, Tokyo (JP)

(72) Inventor: Tsuyoshi Sanada, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/504,567

(22) Filed: Oct. 2, 2014

(65) Prior Publication Data

US 2015/0097913 A1 Apr. 9, 2015

(30) Foreign Application Priority Data

Oct. 4, 2013 (JP) ..... 2013-208788
Jul. 14, 2014 (JP) ..... 2014-144415

(51) Int. Cl.
*B41J 11/00* (2006.01)

(52) U.S. Cl.
CPC ..... *B41J 11/0045* (2013.01)

(58) Field of Classification Search
USPC ..... 347/16, 171, 197, 198, 216–215, 347/217–219, 222; 400/611, 613, 618, 621, 400/621.1; 271/3.14, 3.18, 3.2
See application file for complete search history.

(56) References Cited

U.S. PATENT DOCUMENTS

| | | | | |
|---|---|---|---|---|
| 5,206,660 | A * | 4/1993 | Cochrane et al. | 347/218 |
| 8,550,446 | B2 * | 10/2013 | Jiang et al. | 271/3.14 |
| 2010/0230889 | A1 | 9/2010 | Eoka et al. | |
| 2012/0200025 | A1 * | 8/2012 | Isobe et al. | 271/3.14 |

* cited by examiner

*Primary Examiner* — Kristal Feggins
(74) *Attorney, Agent, or Firm* — Amin, Turocy & Watson, LLP

(57) ABSTRACT

A printing apparatus comprises a first conveyance guide which conveys a first printing medium inserted from an inserting port via a given printing position in a downstream direction, and conveys the first printing medium in an opposite direction to discharge it from the inserting port; a first printing section which carries out printing on the first printing medium at the printing position; a second printing section which is different from the first printing section in the printing method; and a second conveyance guide which merges with the first conveyance guide to discharge a second printing medium printed by the second printing section from the inserting port through the first conveyance guide; wherein the second printing section is supported to be capable of rotating in a direction orthogonal to the surface of the first printing medium so that one part constituting the second conveyance guide can be opened.

5 Claims, 9 Drawing Sheets

PRINTING APPARATUS

CROSS-REFERENCE TO RELATED APPLICATION

The present application is based upon and claims the benefit of priorities from Japanese Patent Application No. 2013-208788 filed on Oct. 4, 2013 and Japanese Patent Application No. 2014-144415 filed on Jul. 14, 2014, the entire contents of which are hereby incorporated by reference.

FIELD

Embodiments described herein relate to a printing apparatus provided with a printing section carrying out printing through a stationary line head.

BACKGROUND

Conventionally, there is known a printing apparatus in which a thermal printing section provided with a stationary line head and a dot printing section provided with a dot head are arranged in a same housing.

However, the thermal printing section is fixed in the housing. In a case of releasing the jam of the printed paper or in a case in which a fault occurs in the printing section, it takes much time for the access to the jam position or the fault position, thus, it is desired to make it easy to release jam and to carry out maintenance processing.

DETAILED DESCRIPTION

In accordance with one embodiment, a printing apparatus comprises, in a same housing, a first conveyance guide configured to convey a first printing medium inserted from an inserting port via a given printing position in a downstream direction, and convey the first printing medium in a direction opposite to the downstream direction and discharge the first printing medium from the inserting port; a first printing section configured to carry out printing on the first printing medium conveyed to the printing position; a second printing section configured to be different from the first printing section in the printing method; and a second conveyance guide configured to merge with the first conveyance guide to discharge a second printing medium printed by the second printing section from the inserting port through the first conveyance guide; wherein the second printing section is supported to be capable of rotating in a direction orthogonal to the surface of the first printing medium so that one part constituting the second conveyance guide can be opened.

Hereinafter, the embodiment is described in detail with reference to the accompanying drawings.

(A First Embodiment)

Figure 1:
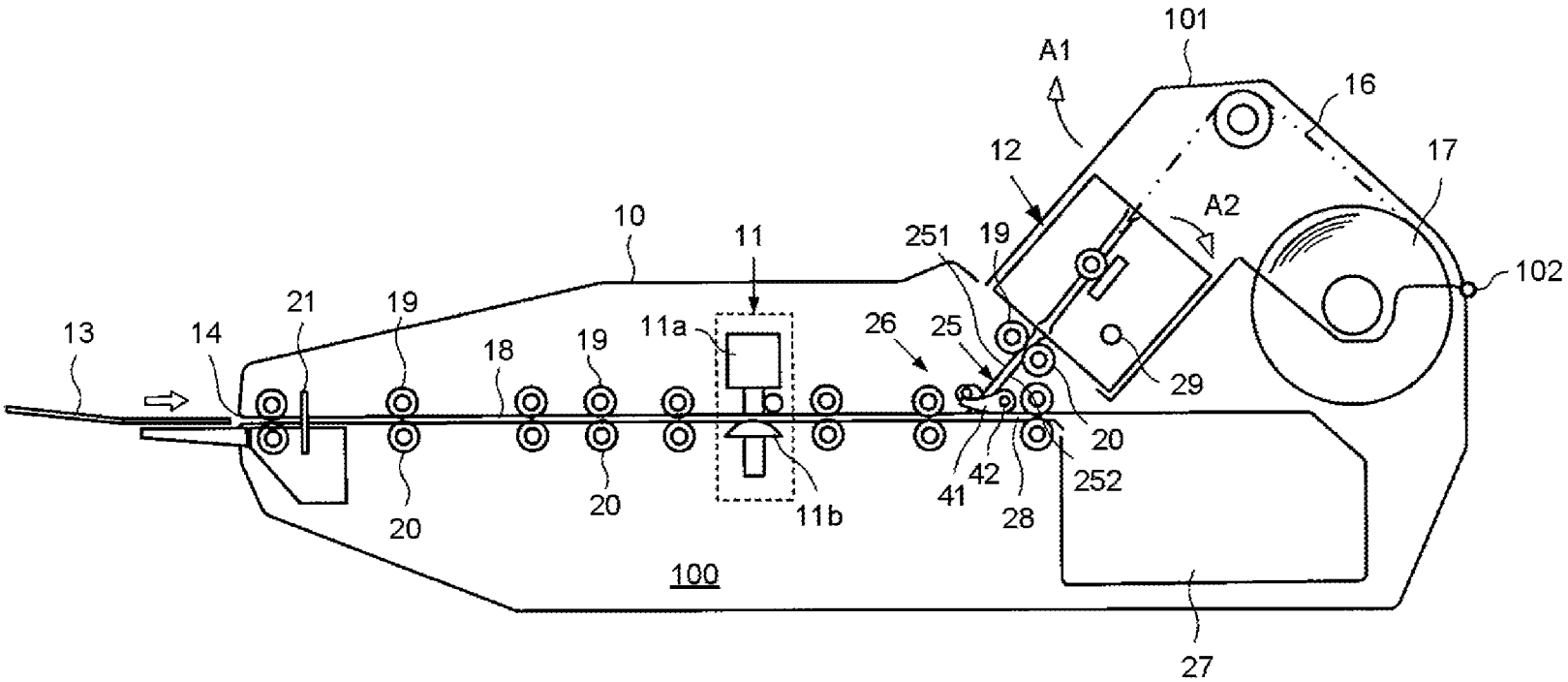
FIG. 1 is a diagram illustrating the internal constitution of a printing apparatus according to a first embodiment.

FIG. 1 is a diagram illustrating the internal constitution of a printing apparatus according to the first embodiment. The embodiment exemplifies a printer 100, which is provided with a dot printing section 11 and a thermal printing section 12 having different printing methods, as the printing apparatus.

In FIG. 1, an inserting port 14 for inserting, for example, a passbook 13 serving as a first printing medium is arranged at the left end of a housing 10 of the printer 100 shown in FIG. 1. At a position at the left side of the center part of the printer 100 is arranged, for example, the dot printing section 11 serving as a first printing section for carrying out printing on the inserted passbook 13. The dot printing section 11 includes a serial head moving in a printing direction to carry out serial printing. The passbook 13 subjected to the printing by the dot printing section 11 is conveyed reversely in the printer 100 in a manner described later and then discharged from the inserting port 14.

At the right side of the printer 100 shown in FIG. 1 is arranged, for example, the thermal printing section 12 serving as a second printing section for carrying out printing on a business form paper 16 (second printing medium) such as an account statement. The thermal printing section 12 includes a stationary line head for carrying out line printing. The thermal printing section 12 carries out given printing on, for example, the business form paper 16 supplied from a paper supplying section 17 of the printer 100 to create a business form such as an account statement.

The business form paper 16 wound in a roll-shape is stored in the paper supplying section 17. The thermal printing section 12 takes in the business form paper 16 from the paper supplying section 17 from the right side of FIG. 1, carries out given printing and then conveys the business form paper 16 towards the left side. The printed business form paper 16 is cut by a cutter (not shown) and then discharged from the inserting port 14 at the left end through a conveyance guide (described later) in the printer 100.

A first conveyance guide 18 is arranged in a linear manner in the printer 100 from the inserting port 14 towards the right side of FIG. 1. The dot printing section 11 is arranged at the middle of the first conveyance guide 18. The first conveyance guide 18 conveys the passbook 13 inserted from the inserting port 14 towards a given printing position of the dot printing section 11. After the printing is carried out by the dot printing section 11, the passbook 13 is conveyed (fed back) in a direction opposite to the downstream direction and discharge from the inserting port 14.

Specifically, the first conveyance guide 18 is provided with a plurality of pairs of upper driving rollers 19 and lower pinch rollers 20 along a conveyance direction. At a position near the inserting port 14 of the first conveyance guide 18 is arranged a shutter 21 which can be opened and closed. Generally, the shutter 21 is closed so that the passbook 13 cannot enter the inside of the printer 100. A paper width detection sensor (not shown) for detecting the paper width of the passbook 13 inserted from the inserting port 14 and a paper insertion sensor (not shown) for detecting the insertion of the passbook 13 are arranged at the front side of the shutter 21.

The two pairs of upper driving rollers 19 and lower pinch rollers 20 arranged at the upstream and the downstream sides of the shutter 21 on the first conveyance guide 18 are arranged at such an interval that the passbook 13 having the shortest paper length can be pinched by the two pairs of rollers at the same time. The part of the first conveyance guide 18 at the downstream side of the shutter 21 serves as an alignment area where the passbook 13 is aligned for the dot printing section 11.

In the alignment area, a sensor for detecting the paper length of the passbook 13 and a driving roller and a pinch roller (not shown) for moving the passbook 13 towards an alignment section arranged at one side (not shown) of the first conveyance guide 18 in a direction orthogonal to the conveyance direction are arranged. In the following description, the driving roller and the pinch roller are referred to as alignment rollers.

The dot printing section 11 includes a dot head 11*a* and a platen 11*b* vertically arranged across the first conveyance guide 18. The platen 11*b* is arranged in a direction orthogonal to the surface of the passbook 13 to cross the conveyance direction of the first conveyance guide 18 on the first conveyance guide 18. The dot head 11*a* reciprocates above the platen 11*b* along the length direction of the platen 11*b*, that is, a direction crossing the conveyance direction of the first conveyance guide 18. The dot head 11*a* carries out printing on a printing page of the passbook 13 positioned on the platen 11*b*.

The printing width of the printing carried out by the dot head 11*a* is set to the maximum width of the passbook 13 to be printed. The printing start positions, though differs according to the size of the passbook 13, need to be adjusted to a certain position. In the alignment area, the passbook 13 is moved by the alignment rollers in a direction orthogonal to the conveyance direction, and the side part of the passbook 13 is abutted against the alignment section arranged at one side of the conveyance direction to be aligned. The position of the side part of the passbook 13 is aligned (adjusted) to the printing start position on the printing page of the passbook 13 to be printed by the dot head 11*a*.

In addition, a page turning mechanism (not shown) for turning the page of the passbook 13 is arranged at the downstream side of the dot printing section 11 viewed from the inserting port 14 of the printer 100. The page turning mechanism turns the page of the passbook 13 so that the printing is carried out on the next page in a case in which the printing carried out by the dot printing section 11 crosses the last line of the current printing page.

The thermal printing section 12 used as the second printing section is arranged at the downstream side viewed from the inserting port 14. The thermal printing section 12 takes in the business form paper 16 from the paper supplying section 17, carries out given printing and then conveys the business form paper 16 towards the left side of FIG. 1.

The business form paper 16 printed by the thermal printing section 12 is conveyed by a second conveyance guide 25 to a mergence section 26. A pair of upper driving roller 19 and lower pinch roller 20 is arranged on the second conveyance guide 25, and the paper printed by the thermal printing section 12 is cut by the cutter (not shown). The business form paper 16 conveyed to the mergence section 26 is merged with the first conveyance guide 18 in the mergence section 26 and then discharged from the inserting port 14.

A switchable flapper 41 is arranged in the mergence section 26. The flapper 41 is supported to be capable of rotating around a supporting shaft 42. In a state in which the flapper 41 is rotated anticlockwise, a mergence path is formed to guide the paper printed by the thermal printing section 12 from the second conveyance guide 25 to the first conveyance guide 18.

On the contrary, in a state in which the flapper 41 is rotated clockwise, a collection path 28 is formed to connect the first conveyance guide 18 with a collection box 27.

The collection path 28 is used to collect the passbook 13 or the business form paper 16 that a user forgets to take and is left at the inserting port 14. The passbook 13 or the business form paper 16 conveyed from the first conveyance guide 18 to the collection path 28 is guided to the collection box 27. That is, the flapper 41 is arranged in the mergence section 26 of the first conveyance guide 18 and the second conveyance guide 25 to carry out a switching operation to form the mergence path or the collection path 28 mentioned above.

Figure 2:
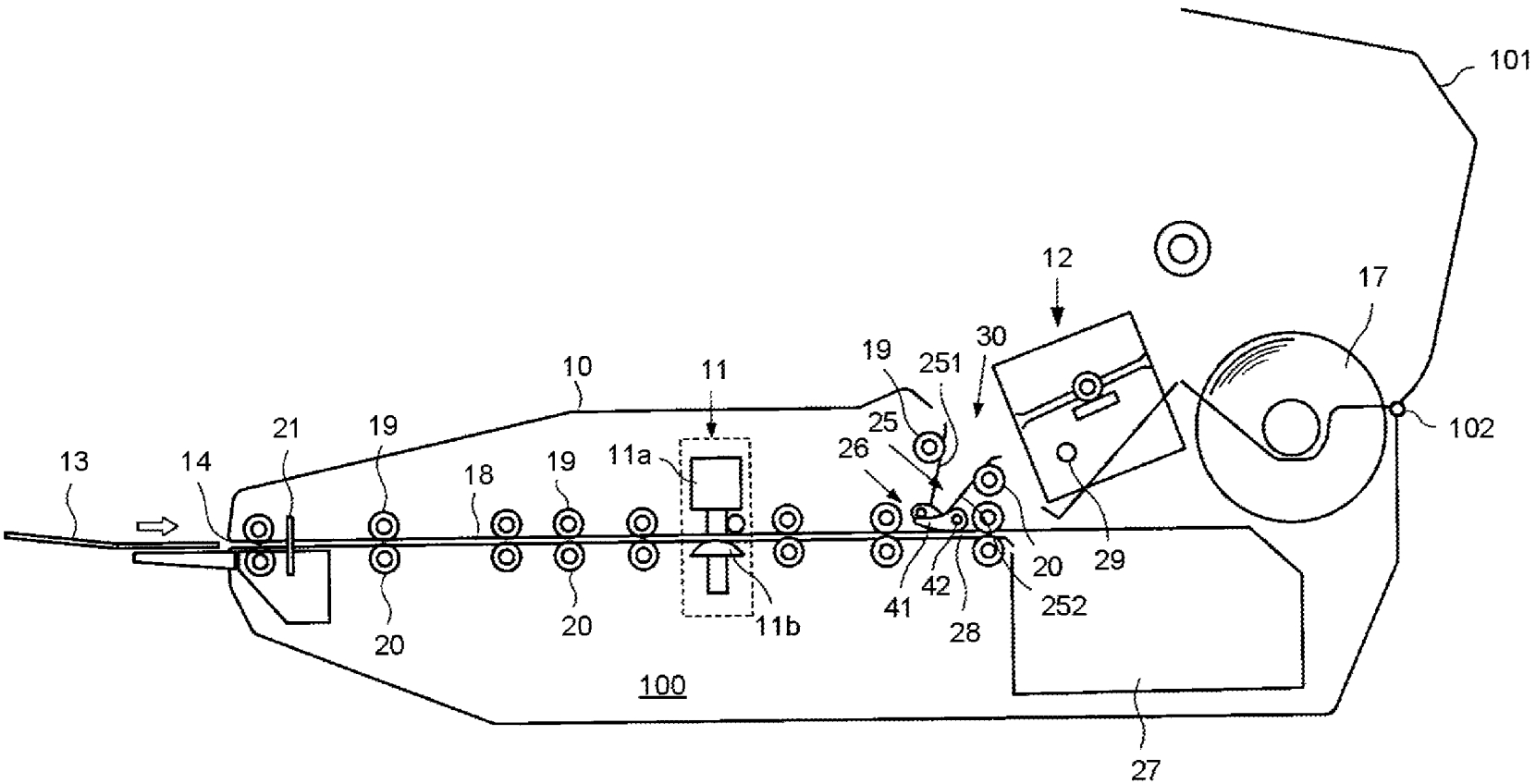
FIG. 2 is a diagram illustrating a maintenance state of the printing apparatus shown in FIG. 1.

As shown in FIG. 2, on the housing 10 that covers the upper portions of the thermal printing section 12 and the paper supplying section 17, an opening and closing lid 101 is formed as one part of the housing 10. The opening and closing lid 101 is supported in an openable manner by a hinge 102 arranged at the back side opposite to the side where the inserting port 14 is arranged. The opening and closing lid 101 is closed during printing process and opened during maintenance process. Thus, when the opening and closing lid 101 is opened, the jam or replenishment of the business form paper 16 can be carried out.

Figure 3:
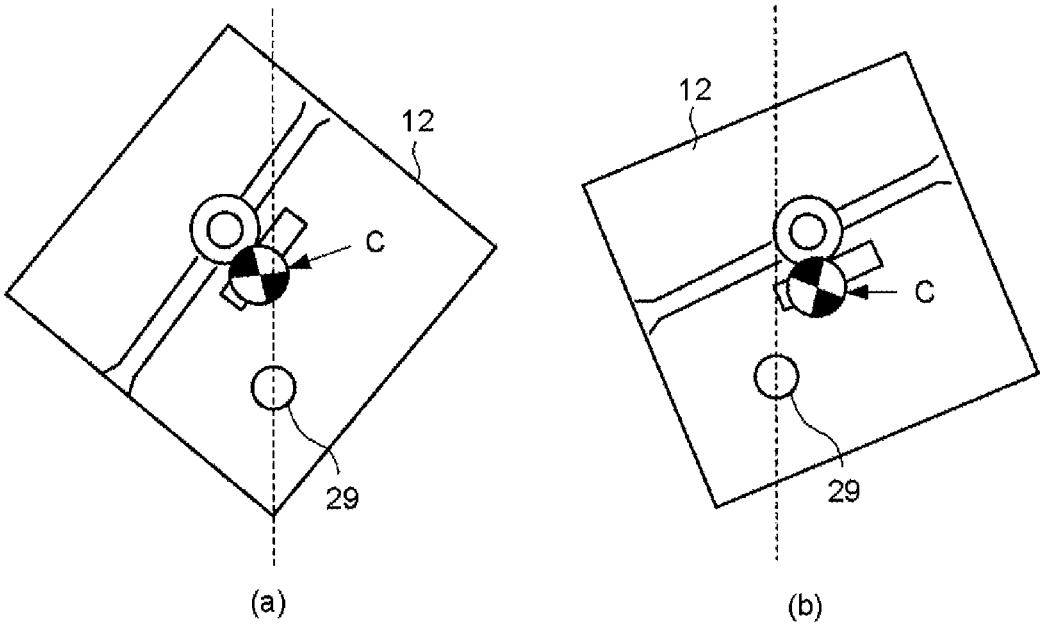
FIG. 3*a* is a diagram illustrating the relation between a centroid and a supporting shaft of the thermal printing section.
FIG. 3*b* is a diagram illustrating the relation between a centroid and a supporting shaft of the thermal printing section.

The thermal printing section 12 is supported to be capable of rotating (between a printing position and a maintenance position) around the supporting shaft 29 in a direction orthogonal to the business form paper 16. As shown in FIG. 3, the supporting shaft 29 serving as the rotation center is arranged nearby a centroid C of a direction orthogonal to the longitudinal direction of the thermal printing section 12. FIG. 3 (*a*) is a diagram illustrating a position where the thermal printing section 12 can carry out printing. FIG. 3 (*b*) is a diagram illustrating a position where the thermal printing section 12 is rotated clockwise around the supporting shaft 29 to an end position and the maintenance can be carried out.

In this way, as the supporting shaft 29 is arranged nearby the centroid C, the load generated when the thermal printing section 12 is rotated can be reduced. When the thermal printing section 12 is rotated to the end position of the rotation track, the exchange of a printing circuit substrate (not shown) carrying a driving circuit, a driving motor and a cutter of the thermal printing section 12, and the access to the inspection position can be easily carried out.

As to paper guides 251 and 252 constituting the second conveyance guide 25, the upper paper guide 251 is supported to be capable of rotating by taking the lower side thereof as a fulcrum. The driving roller 19 constituting part of the second conveyance guide 25 is supported to be capable of rotating by the paper guide 251.

As shown in FIG. 2, the driving roller 19 is also moved as the paper guide 251 is rotated (opened) anticlockwise. In this way, the part nearby the mergence section 26 where the jam of the business form paper 16 occurs easily is opened (exposed), which makes the jam release work much more easier.

The supporting shaft 29 may be arranged at or nearby the centroid C. In this case, the clockwise or anticlockwise rotation of the thermal printing section 12 is easy, thus, it is preferred that the thermal printing section 12 rotated to the end position for the maintenance work is maintained at the maintenance position by a lock mechanism.

As shown in FIG. 3, the supporting shaft 29 may also be arranged below the centroid C. In this case, as shown in FIG. 3 (*b*), when the centroid C is moved together with the thermal printing section 12 to a position at the right side of the dashed line, a clockwise force acts on the thermal printing section 12, therefore, the lock mechanism for maintaining the thermal printing section 12 at the maintenance position can be omitted.

In the present embodiment, the thermal printing section 12 can be rotated and part of the second conveyance guide 25 can be opened, which makes the access for releasing the jam of the business form paper 16 and the access for exchanging the components of the thermal printing section 12 much easier.

(A Second Embodiment)

Figure 4:
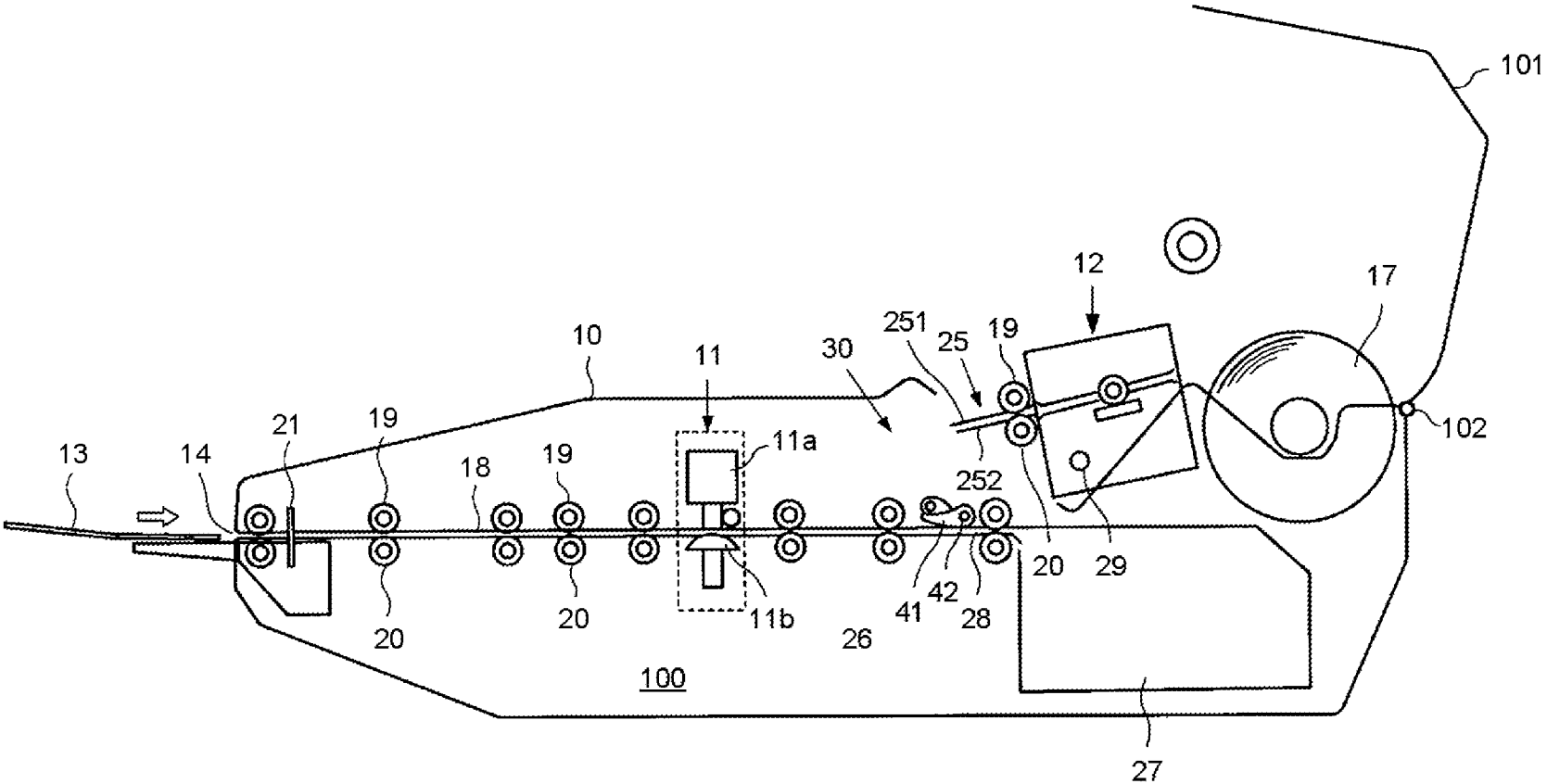
FIG. 4 is a diagram illustrating the internal constitution of a printing apparatus according to a second embodiment.

FIG. 4 is a diagram illustrating the internal constitution of a printing apparatus according to the second embodiment. In the second embodiment, the second conveyance guide 25 as well as the thermal printing section 12 can be rotated. In the second embodiment, the same components as those described in the first embodiment are applied with the same reference marks and only the different parts are described, and so it is with the following embodiments.

That is, the second conveyance guide 25 is attached to the thermal printing section 12. The thermal printing section 12 is rotated in a clockwise direction in FIG. 4 around the supporting shaft 29. At this time, as shown in FIG. 4, the second conveyance guide 25 attached to the thermal printing section 12 is also rotated together with the thermal printing section 12.

The thermal printing section 12 and the second conveyance guide 25 are rotated integrally, thus, a space 30 is formed at the position where the second conveyance guide 25 is arranged in the printing process. The space 30 can make the access for the exchange of the components of the thermal printing section 12 easier. Further, the space 30 can also make the access for releasing the jam of the business form paper 16 easier.

Figure 5:
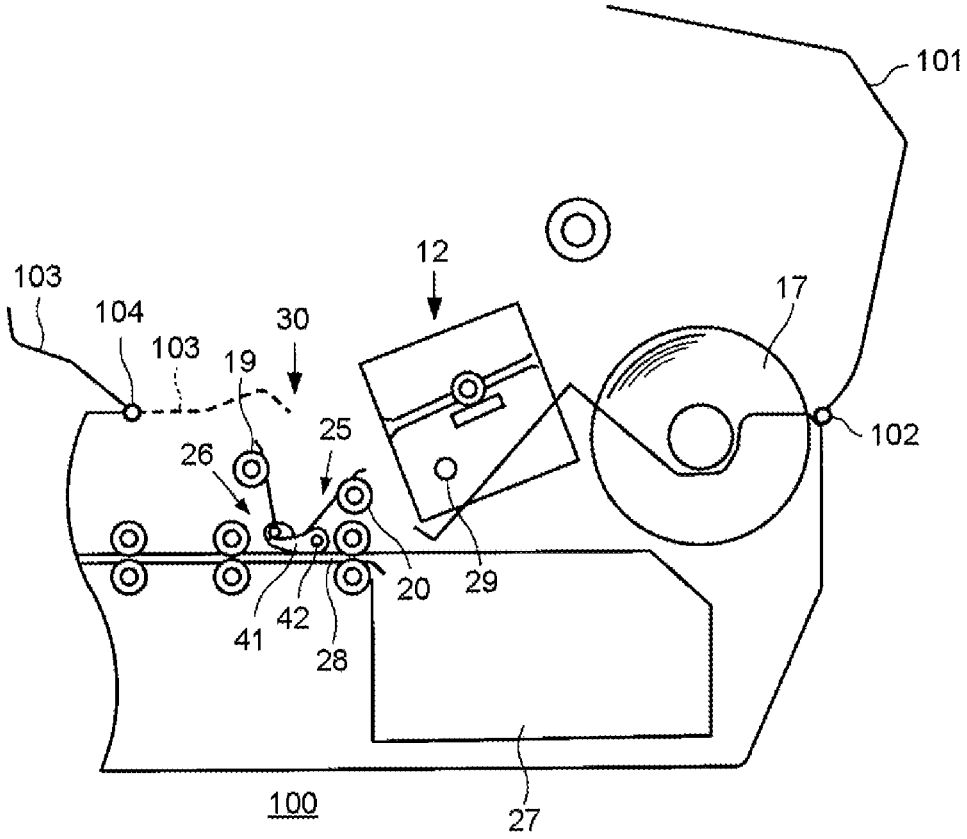
FIG. 5 is a partially cutaway diagram illustrating the constitution in a modification of the first embodiment.
Figure 6:
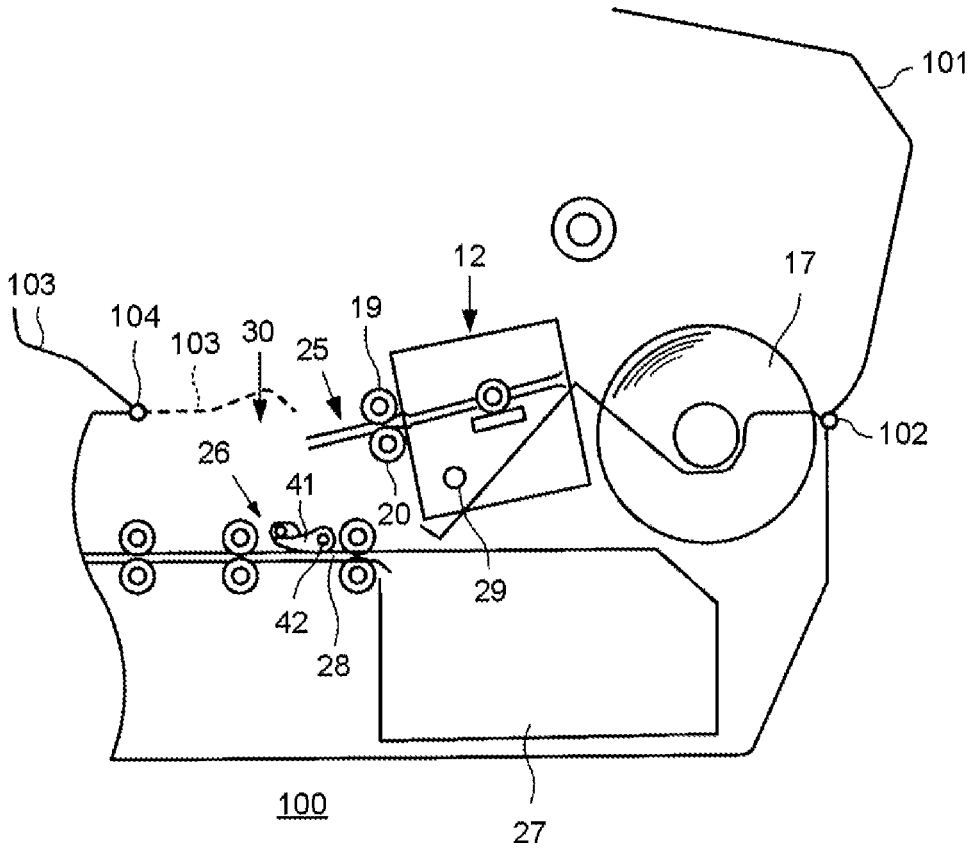
FIG. 6 is a partially cutaway diagram illustrating the constitution in a modification of the second embodiment.

FIG. 5 is a diagram illustrating a modification of the first embodiment. FIG. 6 is a diagram illustrating a modification of the second embodiment.

In both modifications shown in FIG. 5 and FIG. 6, part of the housing 10 above the second conveyance guide 25 is formed as an opening and closing door 103. The opening and closing door 103 can be opened and closed, through a hinge 104, between a closed position indicated by dashed line and an opened position indicated by solid line. The hinge 104 of the opening and closing door 103 is arranged at a side opposite to the side where the hinge 102 of the opening and closing lid 101 is arranged. In this way, the opening and closing door 103 and the opening and closing lid 101 are in a double door state.

For example, the opening and closing lid 101 is opened to exchange the business form paper 16. Further, in a case of releasing the jam of the business form paper 16 or inspecting the thermal printing section 12, the opening and closing lid 101 and the opening and closing door 103 are opened to carry out the work. In a case in which the opening and closing lid 101 and the opening and closing door 103 are opened, the work of rotating the thermal printing section 12 becomes easier. The space 30 generated by rotating the thermal printing section 12 makes the space more open compared with the opening of the opening and closing lid 101 and the opening and closing door 103, which can make the access much more easier.

In each modification, the opening and closing lid 101 and the opening and closing door 103 are selectively opened according to the necessity of coping with the fault of the thermal printing section 12, exchanging the business form paper 16 and releasing the jam of the business form paper 16, which can improve the work efficiency.

(A Third Embodiment)

Figure 7A:
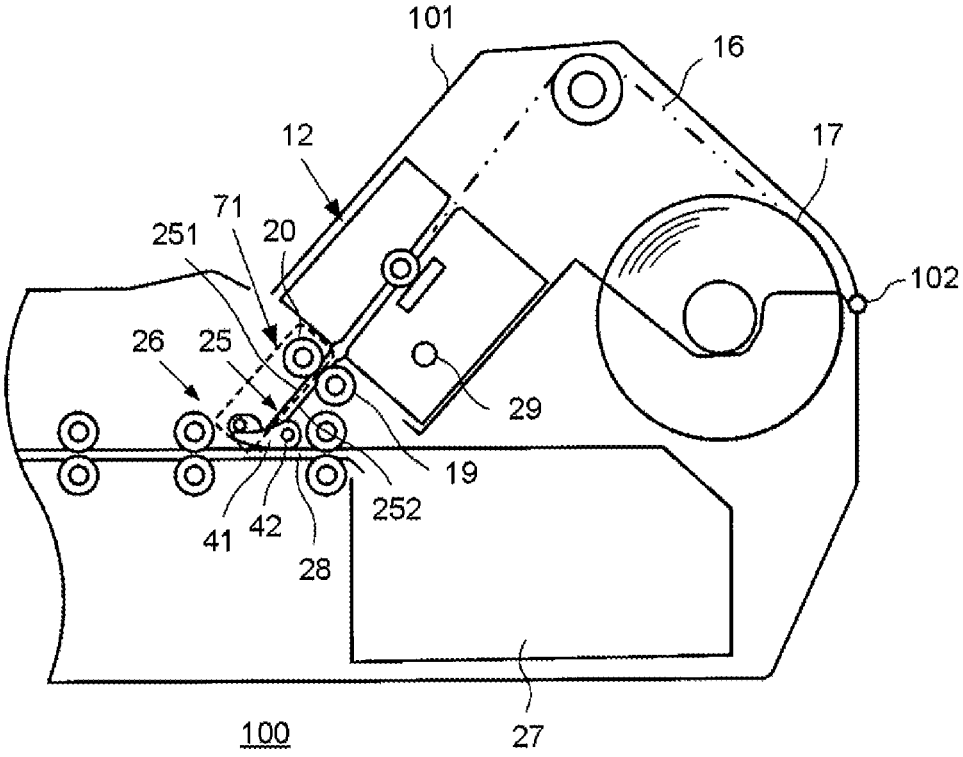
FIG. 7A is a partially cutaway diagram illustrating the constitution in a third embodiment.
Figure 7B:
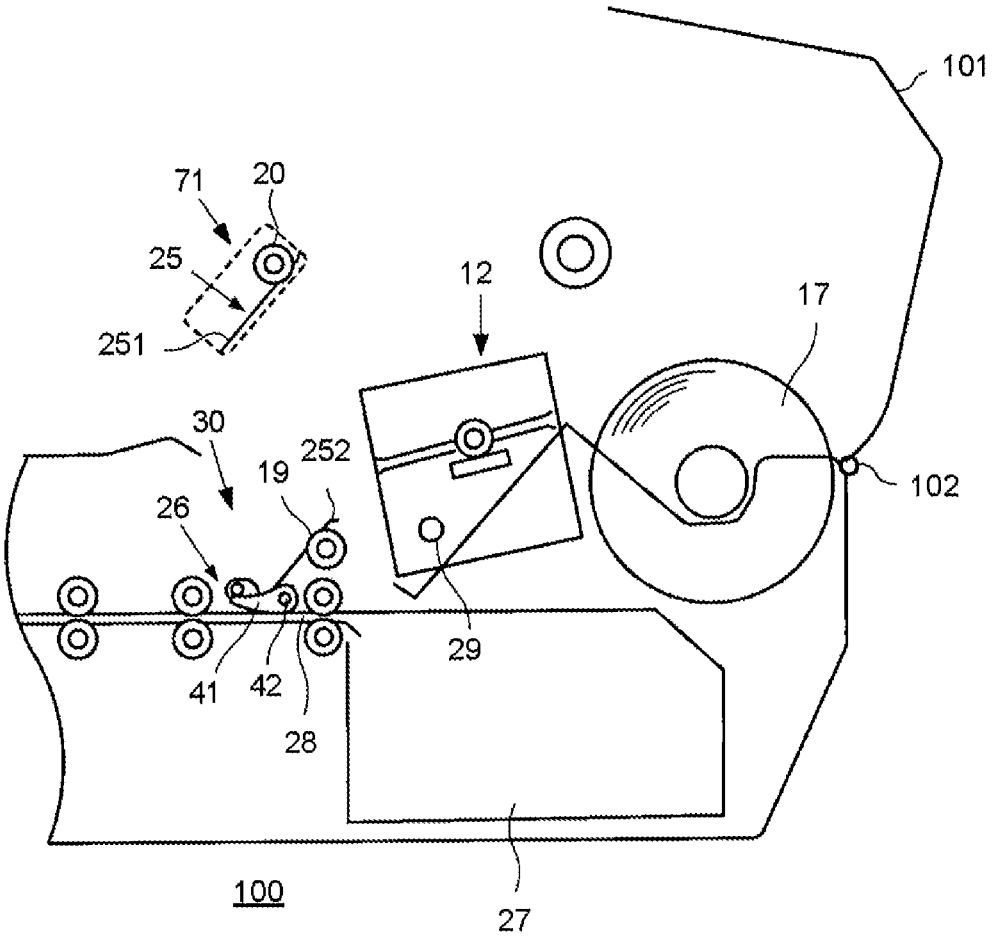
FIG. 7B is a partially cutaway diagram illustrating the constitution in the third embodiment.

FIG. 7A and FIG. 7B are diagrams illustrating the internal constitution of a printing apparatus according to the third embodiment.

In the third embodiment, part of the second conveyance guide 25 and the like is unitized and can be detached from the printer 100 in a state in which the thermal printing section 12 is rotated.

That is, the paper guide 251 and the pinch roller 20 arranged at the upper side of the second conveyance guide 25 are unitized as a conveyance block 71. The driving roller 19 is arranged at the side of the lower paper guide 252. The driving roller 19 is arranged to face the conveyance guide from the paper guide 252 to be capable of conveying the business form paper 16. Compared with the arrangement in the embodiments described above, the pinch roller 20 and the driving roller 19 are arranged at opposite positions.

The drive shaft of the driving roller 19 is rotatably supported in supporting holes of the frame arranged at both sides of the conveyed business form paper 16 and is driven under the driving of a driving source. Gears (not shown) are arranged at two ends of the driving roller 19.

The upper paper guide 251 is attached to the conveyance block 71, and the pinch roller 20 is also attached to the conveyance block 71 in a rotatable manner. The pinch roller 20 is arranged to face the conveyance guide from the paper guide 251 to be capable of conveying the business form paper 16. Gears (not shown) meshing with the gears of the driving roller 19 are arranged at two ends of the pinch roller 20.

In a state in which the gears of the pinch roller 20 mesh with the gears of the driving roller 19, the conveyance block 71 is attached to the frame through an attaching and detaching mechanism in such a manner that the paper guides 251 and 252 face each other.

FIG. 7A shows a state in which the conveyance block 71 is attached, and FIG. 7B shows a state in which the conveyance block 71 is detached. The attachment and detachment of the conveyance block 71 is described below.

First, the user opens the opening and closing lid 101 in a state shown in FIG. 7A, and then rotates the thermal printing section 12 around the supporting shaft 29 to the state shown in FIG. 3 (*b*). In this way, the opening and closing lid 101 and the thermal printing section 12 are in the state shown in FIG. 7B.

The space 30 is obtained by opening the opening and closing lid 101 and rotating the thermal printing section 12. The conveyance block 71 is removed from the part where the conveyance block 71 is connected with the frame. Then the meshing of the gears of the pinch roller 20 and the gears of the driving roller 19 are released, in this way, the conveyance block 71 is taken out as shown in FIG. 7B.

In this way, the second conveyance guide 25 is in an opened state. The space 30 is further widened due to the detachment of the conveyance block 71. As the second conveyance guide 25 is opened and the space 30 is widened, the access for exchanging the components of the thermal printing section 12 and the access for releasing the jam of the business form paper 16 can be improved.

In the present embodiment, the opening and closing door 103 for opening part of the housing 10 above the second conveyance guide 25 may also be arranged separately from the opening and closing lid 101 for exchanging the business form paper 16 as shown in FIG. 5. In this case, the workability of the attachment and detachment of the detachable conveyance block 71 can be improved.

Figure 7C:
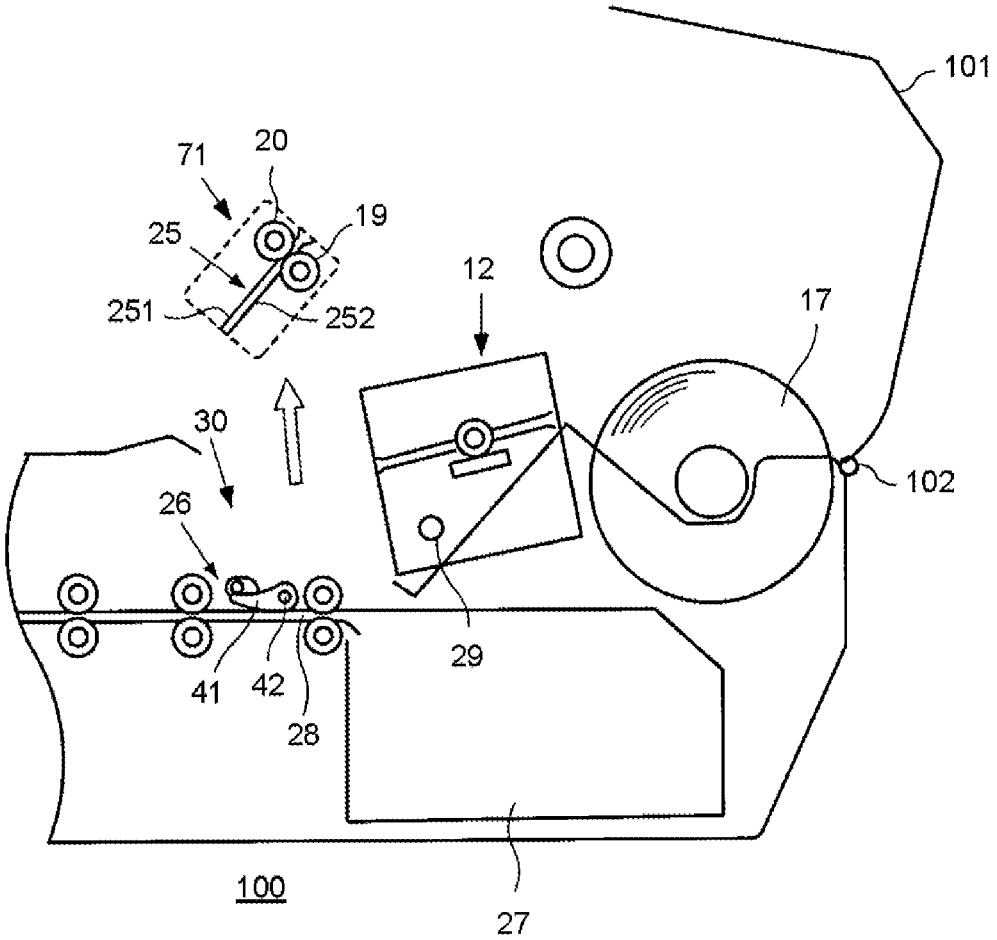
FIG. 7C is a partially cutaway diagram illustrating the constitution in a modification of the third embodiment.

In the present embodiment, the conveyance block obtained by unitizing one part constituting the second conveyance guide is made detachable. However, the present invention is not limited to this. For example, as shown in FIG. 7C, a conveyance block obtained by unitizing the whole second conveyance guide may be made detachable. In any of the embodiments described above, in a case in which the conveyance block is detached, the maintenance such as the exchange of the thermal printing section and the cutter can be carried out easily. The jam of the paper in the thermal printing section can also be released easily.

The present invention is not limited to each embodiment described above. For example, it is exemplified in the first embodiment that the upper paper guide 251 of the second conveyance guide 25 is rotated by taking the lower side thereof as a fulcrum. However, it is also applicable that the paper guide 251 is attached to the thermal printing section 12 and is rotated along with the rotation of the thermal printing section 12.

Further, a printer apparatus having two different printing methods (serial printing method and line printing method) is exemplified, however, a printing apparatus only having the line printing method can also be applied. The present invention can be applied to not only the printing apparatus but also a multi-function peripheral having the printing function and other functions.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printing apparatus, comprising:

a first conveyance guide configured to convey a first printing medium inserted from an inserting port via a given printing position in a downstream direction, and convey the first printing medium in a direction opposite to the downstream direction and discharge the first printing medium from the inserting port;

a first printing section configured to carry out printing on the first printing medium conveyed to the printing position;

a second printing section configured to be different from the first printing section in the printing method; and a second conveyance guide configured to merge with the first conveyance guide to discharge a second printing medium printed by the second printing section from the inserting port through the first conveyance guide; wherein the second printing section is supported to be capable of rotating in a direction orthogonal to the surface of the first printing medium so that one part constituting the second conveyance guide can be opened.

2. The printing apparatus according to claim 1, wherein the second conveyance guide is attached to the second printing section and is rotated along with the rotation of the second printing section.

3. The printing apparatus according to claim 1, wherein the first printing section is a dot printing section and the second printing section is a thermal printing section.

4. The printing apparatus according to claim 1, wherein one part constituting the second conveyance guide is attached to the second printing section and is rotated along with the rotation of the second printing section to open the second conveyance guide.

5. The printing apparatus according to claim 1, wherein at least one part of the components for conveying the second printing medium is unitized to be a conveyance block, and the conveyance block can be detached.

* * * * *